United States Patent [19]

Pekar

[11] Patent Number: 5,074,765

[45] Date of Patent: Dec. 24, 1991

[54] ELASTOMERIC AIR PUMP

[75] Inventor: Robert W. Pekar, Florence, Mass.

[73] Assignee: Dielectrics Industries, Chicopee, Mass.

[21] Appl. No.: 508,418

[22] Filed: Apr. 13, 1990

[51] Int. Cl.[5] ..... F04B 45/00

[52] U.S. Cl. ..... 417/480; 36/29; 441/91

[58] Field of Search ..... 417/434, 440, 374, 480; 36/29, 93; 441/90, 91

[56] References Cited

U.S. PATENT DOCUMENTS

| | | | |
|---|---|---|---|
| 3,068,494 | 12/1962 | Pinkwater | 417/480 X |
| 3,118,596 | 1/1964 | Saile | 417/480 |
| 3,133,696 | 5/1964 | Mirando | 417/480 X |
| 3,155,991 | 11/1964 | Dunham | 417/480 X |
| 3,486,663 | 12/1969 | Humphrey | 417/480 X |
| 3,507,586 | 4/1970 | Gronemeyer et al. | 417/480 |
| 4,552,515 | 11/1985 | Endo | 417/480 X |
| 4,995,173 | 2/1991 | Spier | 36/29 |

FOREIGN PATENT DOCUMENTS

| | | | |
|---|---|---|---|
| 0040189 | 11/1981 | European Pat. Off. . | |
| 2845824 | 5/1979 | Fed. Rep. of Germany | 36/93 |
| 3310812 | 9/1984 | Fed. Rep. of Germany . | |
| 3600437 | 7/1987 | Fed. Rep. of Germany . | |

*Primary Examiner*—Leonard E. Smith

*Attorney, Agent, or Firm*—Chapin, Neal & Dempsey

[57] ABSTRACT

An air pump formed of a resilient elastomeric material bondable about the perimeter of an opening provided in a plastic inflatable bladder, has a self-supporting spherical dome portion and a generally planar base portion. An inlet flapper type valve is integrally formed in a wall of the dome and an outlet check valve extends through an opening in the base for supplying air into the plastic bladder accomplished by alternately compressing and releasing the dome. The underside of the base includes projections disposed about the outlet valve to hold the bladder wall clear of the outlet valve. The base may also include a tail portion which extends laterally of the dome with an exhaust valve affixed thereto for deflating the bladder.

9 Claims, 1 Drawing Sheet

ELASTOMERIC AIR PUMP

BACKGROUND OF THE INVENTION

This invention relates to pumps associated with air inflatable bladders and, more particularly, to such pumps as are formed of a resilient elastomeric material.

Inflatable objects, such as air cushions, mattresses and liners for athletic shoes usually are inflated by discrete pumps, such as the bellows pump disclosed in U.S. Pat. No. 2,686,006 to Hasselguist which is connected by a tube 30 to a check valve affixed to the inflatable bladder.

U.S. Pat. No. 2,698,028 to Lee shows a self-contained pump disclosed wholly within an inflatable cushion.

U.S. Pat. No. 3,583,008 to Edwards discloses a bulb-shaped, self-contained pump 36 connected to each of the inflatable compartments of an air mattress. The bulb pump relies upon a U-shaped spring and a coil spring 54 to expand the bulb after it has been compressed in each stroke of the pump.

Bulb-type pumps have also been used to inflate air cushion liners for athletic shoes and, in general, these have included a rubber bulb with an inlet valve extending outwardly from one side thereof and an outlet neck extending from the opposite side of the bulb. A plastic tube is fitted into the neck of the bulb and a check valve is disposed in a valve housing molded onto the liner. An exhaust valve is separately connected to the liner to deflate the liner when desired.

It is the principal object of this invention to provide an elastomeric pump and self-contained valve construction for an inflatable bladder of simple and compact construction while, at the same time, being reliable in operation.

It is another object of this invention to provide a pump of the above type which, because of its simple construction, lends itself to ease of assembly on an inflatable bladder.

It is a further object of this invention to provide a pump of a low profile especially adapted to be used in inflatable body support applications, such as inflatable athletic shoe liners and back support belts, where compactness, comfort, durability and reliability are essential.

The above and other objects and advantages of this invention will be more readily apparent from the following description read in conjunction with the accompanying drawings in which.

Figure 4:
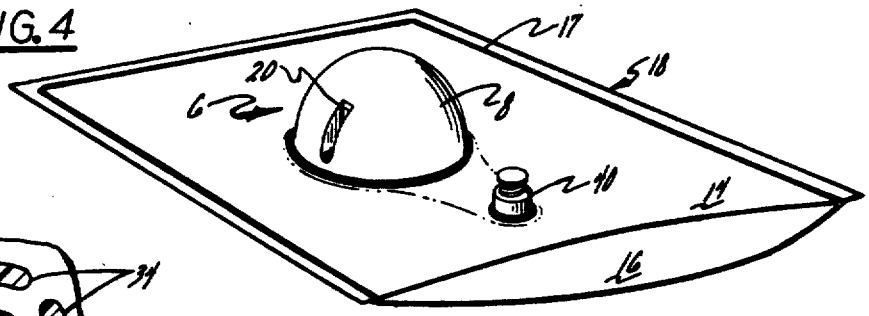
FIG. 4 is an overall perspective view of the pump disposed on an inflatable liner.
Figure 3:
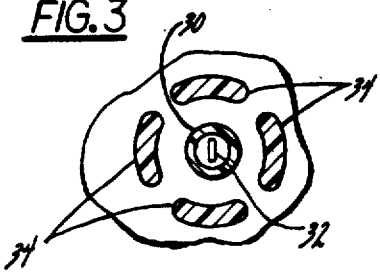
FIG. 3 is a sectional view taken along line 3—3 of FIG. 2.

The pump embodying this invention is shown generally at 6 and comprises an open-sided dome member 8 and a base member 10. The pump is adapted to be fused, heat-sealed or bonded about the periphery of an opening 12 provided through one sheet 14 of an inflatable bladder 18, the other side of the bladder being provided by a sheet 16. The two sheets are adapted to be heat-sealed about the outer edges, as indicated at 17 in FIG. 4, to form the inflatable bladder 18.

Figure 1:
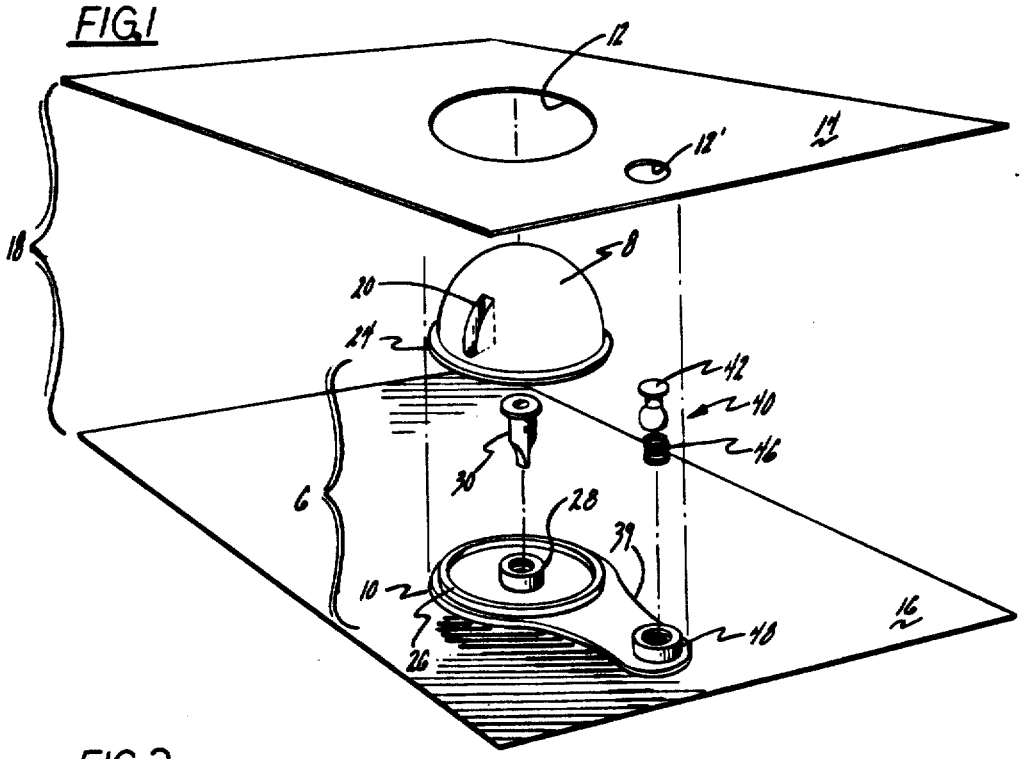
FIG. 1 is an exploded perspective view of an inflatable article and a pump of the type embodying this invention.
Figure 2:
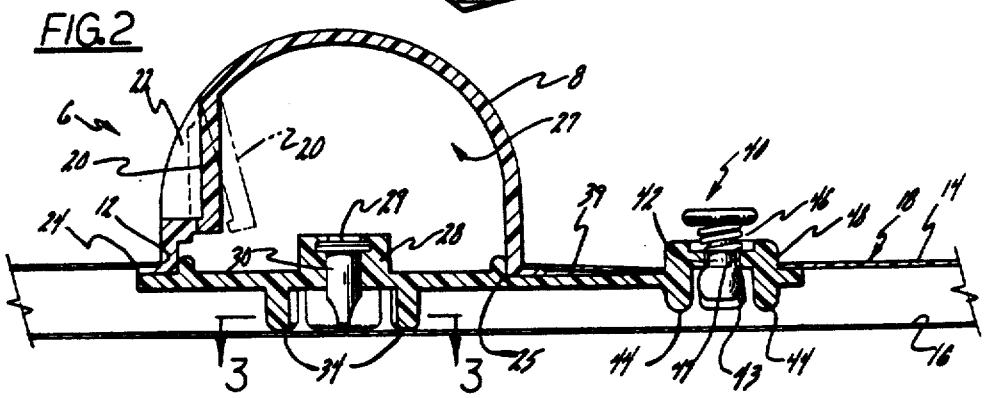
FIG. 2 is cross-sectional, elevational view of the pump of FIG. 1 in assembled relation on the inflatable article.

The dome member 8 of the pump is preferably of hemispherical configuration, open at its planar end, shown in FIGS. 1 and 2, facing downward toward the base member 10. The dome member 8 may be injection-molded of a resilient elastomeric material, such as a polyurethane polymer. Integrally molded into the dome member, is an inlet, check valve, preferably of the flapper type 20. An outwardly extending peripheral flange 24 is formed about the open end of the dome, as at 25 in FIG. 2. The flapper valve 20, formed integrally within a segmental recess 22 in the sidewall of the dome, is slitted about its lower end portion so that this portion will be free to swing in and out, as depicted in FIG. 2. When the dome 8 is compressed, valve 20 will "close" and will "open" as the dome expands to draw in ambient air through the flapper valve 20.

Base 10 comprises a generally planar sheet of the same elastomer as is used to form the dome 8 and it includes an upstanding circular rim 26. The rim 26 has an outer diameter which is somewhat smaller than the inner diameter of the base of the dome 8. With this arrangement, the dome and base can be quickly and easily fitted together and can be simultaneously heat-sealed together and about the margins of opening 12 in the superimposed plastic sheet material 14 which, in part, forms the inflatable bladder 18. In accordance with this invention, the base 10 may either have a circular overall shape which corresponds with that of the lower edge flange 24 of the dome 8 or, preferably, it may have a generally keyhole shape, as best illustrated in FIG. 1. As shown, the larger end of the base 10 corresponds generally to the shape of the circular cutout, or opening 12, and a tail portion 39 extends radially, or laterally from the circular portion and its outer end corresponds to the shape of a second circular cutout 12'. The tail portion 39 provides means for integrally combining with the pump, a push-button type exhaust valve 40 for deflating the bladder.

Outlet valve 30 extends from pumping chamber 27 through the panel 10 within the area defined by the upstanding rim 26. The valve 30 may be any suitable type of check valve which provides one-way air flow from the pumping chamber 27 defined by the dome 8 and base 10 to the inflatable bladder, as at 18. The valve 30 may be a flexible, "duck bill" type fitted into a raised boss, or rim portion 28, of the base panel 10. The boss 28 includes an internal bore therethrough with an annular slot 29 adapted to securely retain an upper flange portion of the valve 30 in place within the base portion of the pump 6. The outlet tip of the valve 30 is flexible and slitted, as at 32, to permit one-way air flow from chamber 27.

A plurality of arcuate projections 34 extend from the lower surface of the panel 10 a somewhat greater distance than does the outlet tip of the valve 30. This construction ensures that the opposed wall portion of the bladder 18 will not interfere with, or inhibit, the air flow through the valve 30 into the inflatable bladder 18.

An elastomer suitable in practicing this invention is one such as polyurethane having a Shore A durometer hardness of 60–75 whereby the dome will have sufficient rebound resilience to perform the necessary pumping function. The top portion of the dome 8 may be about 0.030" in thickness and the lower wall portions, 0.035"–0.060". The thickness of the flange portions 24 and base member 10 may each be approximately 0.030" and the elastomer is preferably heat-sealable.

The exhaust valve 40 includes a stem 42 with an actuator flange or button at its upper end and a generally spherical closure member 43 disposed at its lower end. The stem is biased, "normally closed", by a coil spring 46 and is movable within opening 47 provided through a boss 48 molded as an integral part of the tail portion 39 of the base 10. Depending projections 44 are disposed about the valve head 43 to prevent the sheet 16 of the bladder 18 from interfering with the operation of the valve 40 in much the same manner as the projections 34 served to ensure proper operation of the valve 30.

Among the advantages of this combination of a pump and valve construction, are its adaptability for ease of assembly on an inflatable bladder, such as 18. With the valves 30 and 40 simply fitted into the bores 29 and 47 provided through the base 10, only two parts thereafter need to be handled, i.e., dome 8 and base 10. The dome 8 may be fitted onto the base 10 using the locating rim 26 to facilitate this step. The pump sub-assembly may then be affixed to the bladder 18 which, as illustrated in FIG. 1, is accomplished by fitting the dome 8 through hole 12 in the sheet 14 with the peripheral edges of the flange 24 aligned with margins of the opening 12 in sheet 14 (FIG. 2). At the same time, the exhaust valve 40 would be fitted through opening 12' in sheet 14 and the sub-assembly may then be heat-sealed, fused, welded, or otherwise bonded about the peripheral flange 24 and simultaneously about the peripheral edge of the exhaust valve 40. As a consequence, the dome and the base of the pump are integrated or united and the air pump, exhaust valve and sheet 14 of the bladder are also simultaneously joined together in a unitary structure.

OPERATION

In operation, it is only necessary to manually, by using the finger or thumb, depress and release the resilient elastomeric dome 8 a sufficient number of pulsations until the bladder 18 is properly inflated. During this pumping action, the inlet valve 20 "closes" on a pressure stroke when air from chamber 27 is pumped through the check valve 30 and "opens" on the exhaust stroke when the dome 8 reexpands to its uncompressed condition. When desired to deflate the bladder, such as in an athletic shoe liner, the user need merely depress valve 40 to exhaust the air from the chamber of the bladder.

Having thus described my invention, what is claimed is:

1. Air pump for inflatable bladder comprising an open ended dome member of self-supporting, semi-spherical configuration and a generally planar base member, the dome member being hermetically sealed to the base member about a peripheral edge portion of the open end thereof to form a dome-shaped unitary pumping chamber, the dome member being formed of a resiliently flexible, elastomeric material such that the dome is inherently compressible and expansible, an inlet check valve of the flap type formed by a portion of the elastomeric material of the sperical dome member and an outlet check valve extending through the base member for providing communication between the unitary pumping chamber and the interior of the inflatable bladder.

2. Air pump for inflatable bladder, as set forth in claim 1, in which said elastomer is a urethane polymer.

3. Air pump for inflatable bladder, as set forth in claim 1, in which said elastomer has Shore A durometer hardness in the range of 60–75.

4. Air pump for inflatable bladder, as set forth in claim 1, in which said base member is an elastomer and the dome and base member are heat-sealed together to form the pumping chamber of the pump.

5. Air pump for inflatable bladder, as set forth in claim 4, in which said dome has a planar opening at its major diameter, said bladder includes an opening through one wall portion thereof corresponding to the dome opening, said dome and base members being heat-sealed together and to said bladder about the peripheral edges of said bladder opening.

6. Air pump for inflatable bladder, as set forth in claim 5, in which said base includes at least one projection disposed adjacent said outlet check valve, which extends beyond the end of said check valve to prevent the bladder from blocking air flow through said outlet valve.

7. Air pump for inflatable bladder, as set forth in claim 5, in which said dome includes an outwardly extending peripheral flange about the edge defining its major diameter and said base member includes, on its inner surface, an upstanding annular peripheral rim adapted to interfit within the open edge of the dome.

8. Air pump for inflatable bladder as set forth in claim 1 in which, said base member includes a tail portion extending outwardly of the dome and an exhaust valve extending through the tail portion of the base member for use in deflating said bladder.

9. Air pump for inflatable bladder, as set forth in claim 8, and in which said outlet valve and exhaust valve are each surrounded, at least in part, by projections extending outwardly from the lower surface of the base member a greater distance that the corresponding dimensions of the outlet valve and exhaust valve.

* * * * *